US005634210A

United States Patent [19]

King et al.

[11] Patent Number: 5,634,210

[45] Date of Patent: Jun. 3, 1997

[54] FACE-COVERING FOR PROTECTING A WEARER AGAINST THE SUN

[76] Inventors: Thomas W. King; Annette King, both of P.O. Box 8673, South Lake Tahoe, Calif. 96158

[21] Appl. No.: 665,879

[22] Filed: Jun. 19, 1996

[51] Int. Cl.[6] ..... A41D 13/00

[52] U.S. Cl. ..... 2/9; 2/11; 2/206

[58] Field of Search ..... 2/9, 11, 206, 427, 2/174, 200.1, 12, 171, 171.03, 209.11, 424, 173

[56] References Cited

U.S. PATENT DOCUMENTS

| | | | |
|---|---|---|---|
| D. 359,585 | 6/1995 | King | D29/109 |
| 825,170 | 7/1906 | Allen | 2/206 |
| 1,166,977 | 1/1916 | Favary | 2/11 |
| 1,561,760 | 11/1925 | Whelan | 2/11 |
| 1,637,092 | 7/1927 | Thompson | 2/11 |
| 1,703,034 | 2/1929 | Grimes | 2/206 |
| 1,893,617 | 1/1933 | Flood | 2/11 |
| 3,134,984 | 6/1964 | Ward | 2/206 |
| 3,678,929 | 7/1972 | Buscher | 2/427 |
| 4,027,340 | 6/1977 | Hadtke | 2/206 |
| 4,095,290 | 6/1978 | O'Brien | 2/9 |
| 4,379,349 | 4/1983 | Larson | 2/9 |
| 5,116,288 | 5/1992 | Kondo et al. | 2/9 |
| 5,214,800 | 6/1993 | Braun | 2/206 |

FOREIGN PATENT DOCUMENTS

| | | | |
|---|---|---|---|
| 522823 | 10/1953 | Belgium | 2/11 |
| 190428 | 8/1986 | European Pat. Off. | 2/174 |
| 1116975 | 5/1956 | France | 2/206 |
| 2612376 | 9/1988 | France | 2/174 |

*Primary Examiner*—Amy B. Vanatta

*Attorney, Agent, or Firm*—Terry M. Gernstein

[57] ABSTRACT

A face shield is flexible and includes two side wings that are connected to a main body by living hinges and a face-engaging element that spaces the body away from the face of a wearer. A flexible band attaches the shield to the wearer. The face shield body is opaque to the sun and one form of the shield includes cutouts which are covered with sunglasses-type material. The body is preferably cardboard or other such material so the shield can be folded and bent for storage or to customize it for the particular wearer. The shield can be discarded after use if desired.

15 Claims, 4 Drawing Sheets

FIG. 1.
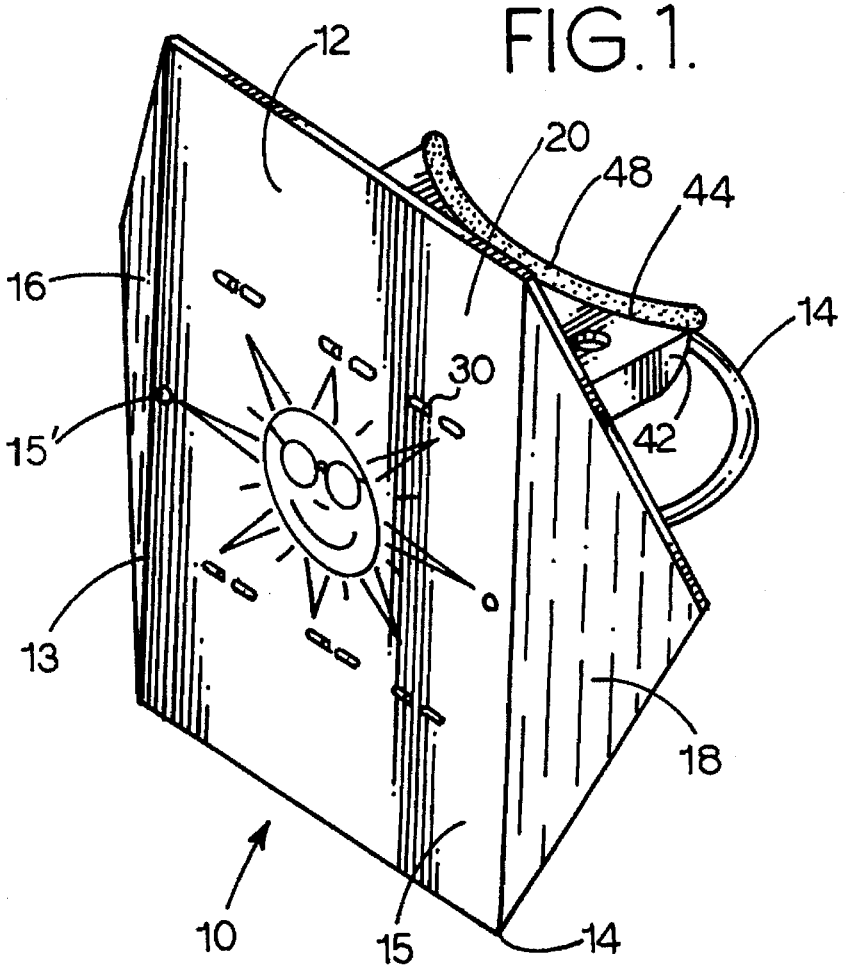
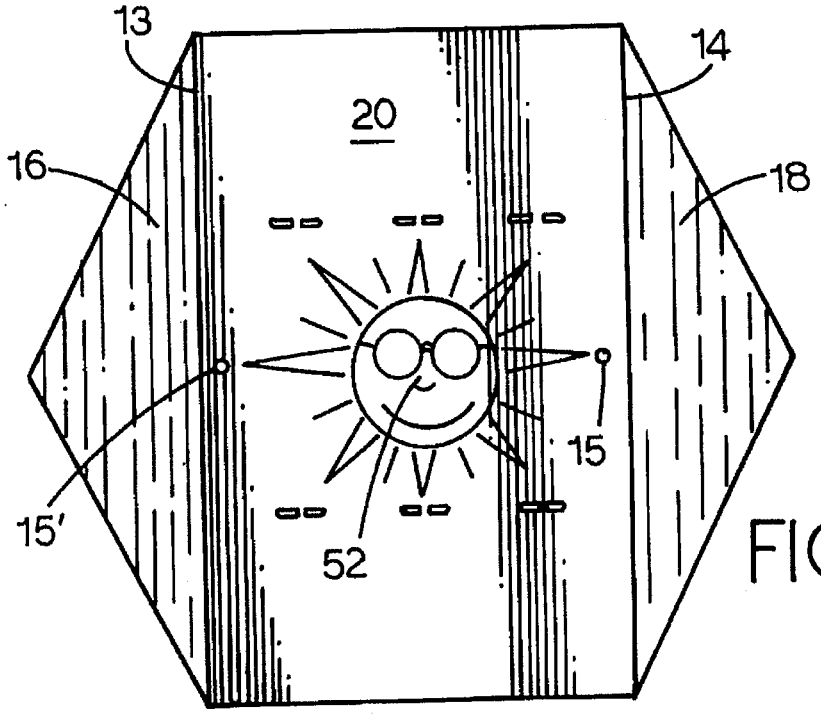
FIG. 2.

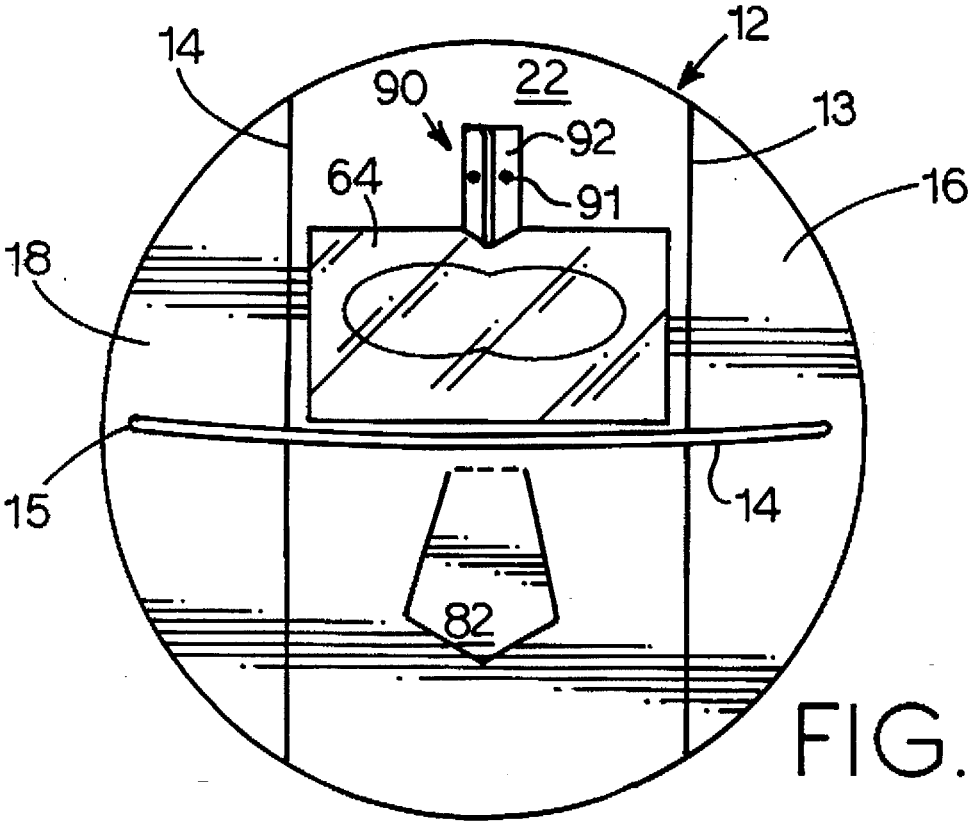
FIG. 7.
FIG. 9.
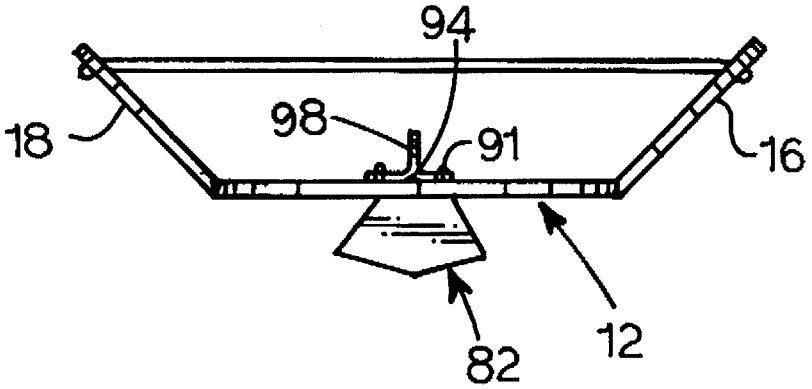

FACE-COVERING FOR PROTECTING A WEARER AGAINST THE SUN

TECHNICAL FIELD OF THE INVENTION

The present invention relates to the general art of face shields, and to the particular field of face shields for protecting a wearer from sun.

BACKGROUND OF THE INVENTION

As more is understood about the effects of the sun on human skin, the more doctors are recommending that a person protect his or her skin from the sun.

Therefore, while there are many lotions and sunglasses known in the art, these items have been found to be only partially effective. Even if they are used in combination with each other, and in combination with other items, such as umbrellas, there have been drawbacks and deficiencies noted. This is especially so since the sun has been found to be even more harmful than initially thought.

Therefore, there is a need for a means for fully protecting a person's skin from the sun, even to the extent now understood.

Umbrellas are often clumsy, expensive and difficult to store. Therefore, many people, especially those on crowded beaches where the sun can be the worst, do not use them.

Sunscreens and other lotions can be only partially effective and some may even wash off or wear off thereby totally removing any protection afforded thereby. This is even more of a problem because a wearer often does not know when some or all of the lotion has worn off and thus is unprotected and does not know it. The effects of the sun's rays are so damaging that one should not risk the protection wearing off, even partially. Nor should one take the chance that some or all of the protection has been accidently removed, such as through contact with a towel, even if the product is designed to remain in place. A wearer should be fully aware of whether protection is in place.

Therefore, there is a need for a means for protecting a wearer from the effects of the sun which is assured of being in place when the wearer believes it to be in place.

Sunglasses and other mechanical means are one common means of protecting a wearer's eyes from the sun. While effective, and while the wearer knows whether or not the protection is in place when desired, these means also have several drawbacks. For example, sunglasses can be expensive. Therefore, if they are lost or damaged, a wearer may incur unwanted costs. Still further, sunglasses are not easily stored nor are they easily adapted for a variety of uses. For example, if a wearer wishes to lie on his or her side, the sunglasses may get in the way. Still further, most sunglasses do not fully protect the side of the wearer's face. Even if the sunglasses have small side wings, these wings only cover the area near the wearer's eyes and do not extend over the full side of the wearer's face. However, the most important drawback of sunglasses is that they do not protect the wearer's face. The sunglasses protect only the wearer's eyes and the area closely adjacent to the eyes.

Therefore, there is a need for a means for protecting a wearer from the effects of the sun which is inexpensive, easily stored and carried and yet protects the wearer's entire face.

Still further, sunglasses must be sized to the wearer. Therefore, an adult cannot loan his or her sunglasses to a child. This requires a family to purchase several pairs of sunglasses. This can be expensive, especially if the children lose their sunglasses. Spare glasses are generally not readily available.

Therefore, there is a need for a means for protecting a person from the sun's effects yet is easily adapted for use by either an adult or a child.

Still further, sunglasses rest directly on a wearer's face and prevent ventilation. Therefore, after some time, the wearer can become uncomfortable.

Therefore, there is a need for a means for protecting a person from the sun's effects yet permits ventilation for comfort.

OBJECTS OF THE INVENTION

It is a main object of the present invention is to provide a means for fully protecting a wearer against the effects of the sun.

It is another object of the present invention to provide a means for fully protecting a wearer against the effects of the sun which is in place when desired.

It is another object of the present invention to provide a means for fully protecting a wearer against the effects of the sun which protects a wearer's full face.

It is another object of the present invention to provide a means for fully protecting a wearer against the effects of the sun which is inexpensive and which is easily stored and carried.

It is another object of the present invention to provide a means for fully protecting a wearer against the effects of the sun which can be adapted for different size wearers.

It is another object of the present invention to provide a means for fully protecting a wearer against the effects of the sun which is comfortable to wear even for long periods of time.

It is another object of the present invention to provide a means for fully protecting a wearer against the effects of the sun which is adaptable for various situations.

SUMMARY OF THE INVENTION

These, and other, objects are achieved by a by a flexible face shield that can be easily folded for storage, yet which is inexpensive so it can be discarded. The face shield includes foldlines which form living hinges in the body thereof so portions of the shield can be pivoted into various relative orientations so the shield can be folded for storage or for fitting a wearer's face whereby the same shield can be used by an adult and by a child and will still be comfortable for either and can be customized for a particular wearer if desired. The face shield further includes means for spacing the shield away from a wearer's face and a flexible band for easily and comfortably holding the shield on the wearer. One form of the shield has a totally opaque body, while a second form of the shield has a cutout section covered by translucent, sunglass-type material. The shield can be in several forms, with circular and hexagonal being disclosed.

In this manner, the wearer is totally assured that his or her face shield is in place when desired, and the face shield covers and fully protects the wearer's entire face when desired. However, being flexible and having living hinges, the face shield can be adapted to various needs, such as covering only one-half of the wearer's face if the wearer desires to lie on his or her side, and sizing the shield for smaller or larger faces. The preferred material for the face shield is cardboard, therefore making the shield inexpensive and easily carried and stored and can be discarded after use if desired. The inexpensive shield can be discarded when desired. The shield also includes a flexible band for comfortably fixing the shield to the wearer, and which can be tied so the shield can be sized for comfortable wearing. The preferred form of the shield has the flexible band formed of elastomeric material.

Therefore, the face shield disclosed herein is totally effective yet is efficient, convenient, inexpensive and is adaptable for a wide variety of users and uses.

BRIEF DESCRIPTION OF THE DRAWINGS FIGURES

FIG. 1 is a front, side and top perspective view of a first form of the face shield of the present invention.

FIG. 2 is a front elevational view thereof.

FIG. 7 is a rear elevational view thereof.

FIG. 9 is a top plan view thereof, the bottom plan view being identical to the top.

DETAILED DESCRIPTION OF THE PREFERRED EMBODIMENT OF THE INVENTION

Figure 3:
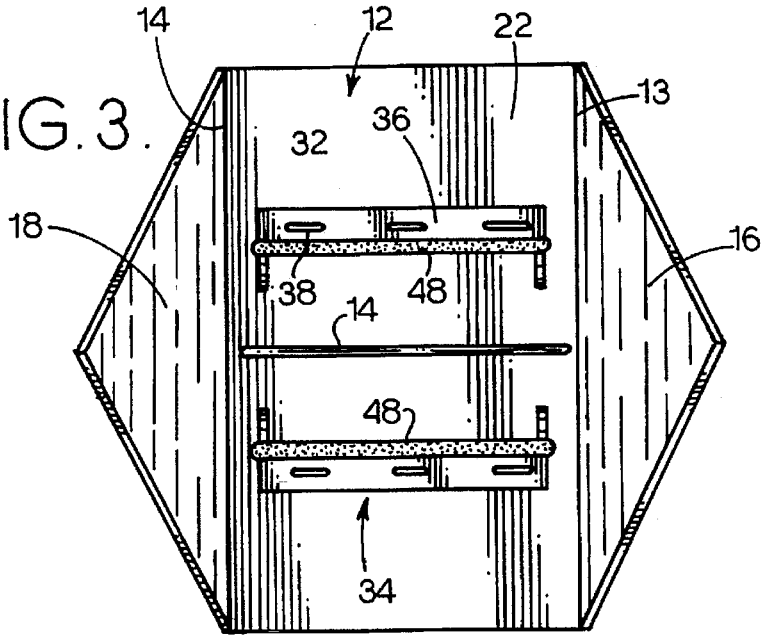
FIG. 3 is a rear elevational view thereof.
Figure 4:
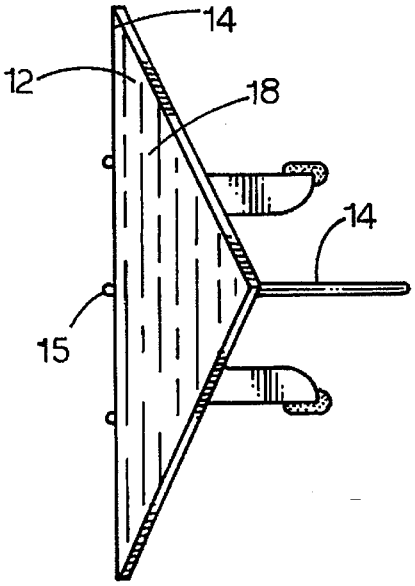
FIG. 4 is a side elevational view thereof, the side opposite being identical to the side shown in FIG. 4.
Figure 5:
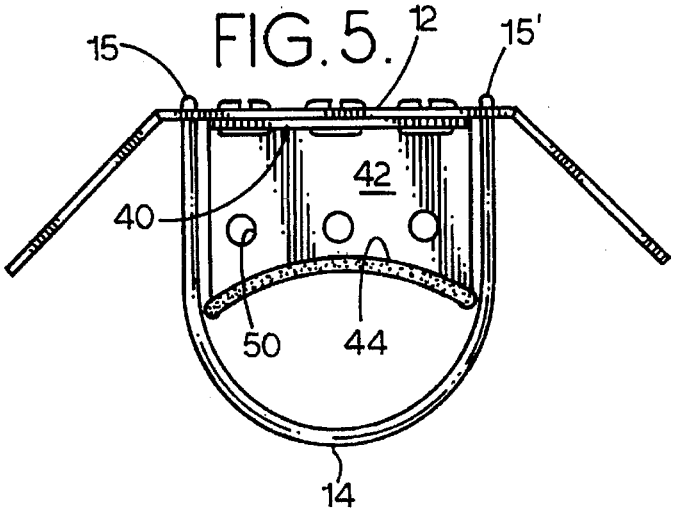
FIG. 5 is a top plan view thereof, the bottom plan view being identical to the top view.
Figure 6:
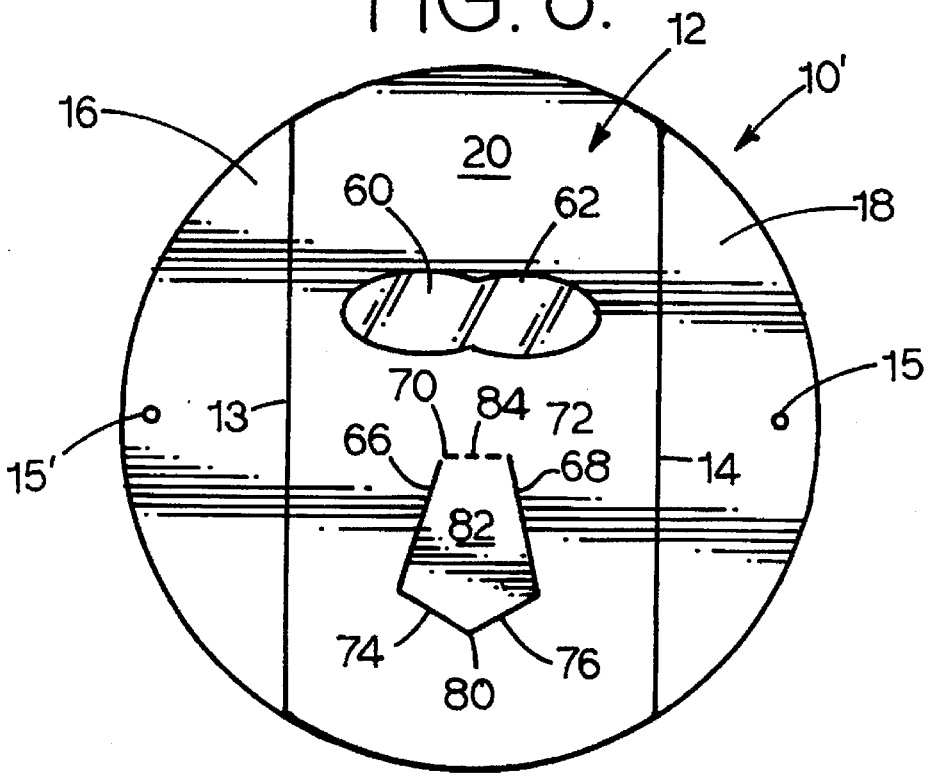
FIG. 6 is a front elevational view of a second form of the face shield of the present invention.

The face shield of the present invention is shown in FIGS. 1–9, with FIGS. 1–5 showing a first face shield 10 and FIGS. 6–9 showing a second form 10' of the face shield. In general, both forms of the face shield include a flexible body 12, two space-apart foldlines 13 and 14 defined in body 12. The foldlines form living hinges whereby body 12 can be folded upon itself so the face shield can be folded for storage, or can be adjusted for various size faces or the like. The preferred material for the face shield is cardboard or other such inexpensive flexible material so the adjusting of the shield is facilitated. The face shield also includes means for spacing said body away from a wearer's face with this means including foldlines forming living hinges whereby the spacing means can be folded to lie adjacent to body 12. The foldlines of the spacing means are located adjacent to body 12. The face shield also generally includes a flexible band 14 connected at each end 15 and 15' thereof to body 12 for holding the body on a wearer. By tying knots in the ends of the band at various locations, the length of the band can be varied to accommodate users of various sizes thereby increasing the versatility of the face shield. The preferred form of the flexible band is elastomeric so the band can be fitted to a wide variety of user sizes in a comfortable manner. The foldlines define, with the peripheral edge of the face shield, side wings 16 and 18 so the side of the wearer's face can be fully protected, yet the wearer can fold the wing out of the way if he or she decides to lie on his or her side. The foldable nature of the side wings also facilitates storage of the face shield. The face shield is preferably planar and has a front surface 20 and a rear surface 22, but the flexible nature thereof permits it to be folded and bent into a configuration which comfortably covers a wearer's face. The preferred form of the face shield has the foldlines parallel with each other, but other orientations of the foldlines can be used without departing from the scope of the present disclosure.

Specifically, a first form of the face shield is shown in FIGS. 1–5 as face shield 10. Face shield 10 is entirely opaque to the sun's rays and is hexagonal in peripheral shape. Thus, the side wings 16 and 18 of face shield 10 are triangular and the central section defined between foldlines 13 and 14 is rectangular.

Face shield 10 includes a plurality of holes, such as hole 30, for providing ventilation to the face of the wearer. The holes 30 are not large enough to expose the wearer to significant amounts of sun, however, the ventilation provided by holes 30 permits a wearer to wear the shield for long periods of time.

Referring to FIG. 3, face shield 10 is seen as including two elements 32 and 34 for spacing the body 12 away from the face of the wearer. These spacer elements provide further comfort to the face shield. As seen in FIGS. 1–3, the elements 32 and 34 are identical in most structure. Therefore, only element 32 will be discussed, with the difference in structure being pointed out. Element 32 includes a base 36 fixed, as by adhesive or staples 38, to rear surface 22 of body 12. A foldline 40 is defined between base 36 and the proximal end of body 42 which has an arcuate distal end 44. The arcuate distal end is curved to match the curvature of a wearer's forehead, while the curvature of the distal end of element 34 is curved to match the curvature of a wearer's chin. Each element 32 and 34 has a soft covering element 48 on the distal end thereof. The covering element is formed of a soft flexible, absorbent material, such as cloth, foam or the like. Each of the bodies 42 has a plurality if circular cutouts, such as hole 50, defined therethrough to provide further ventilation to the wearer.

If desired, printed material, such as design 52, can be placed on front surface 20.

Figure 8:
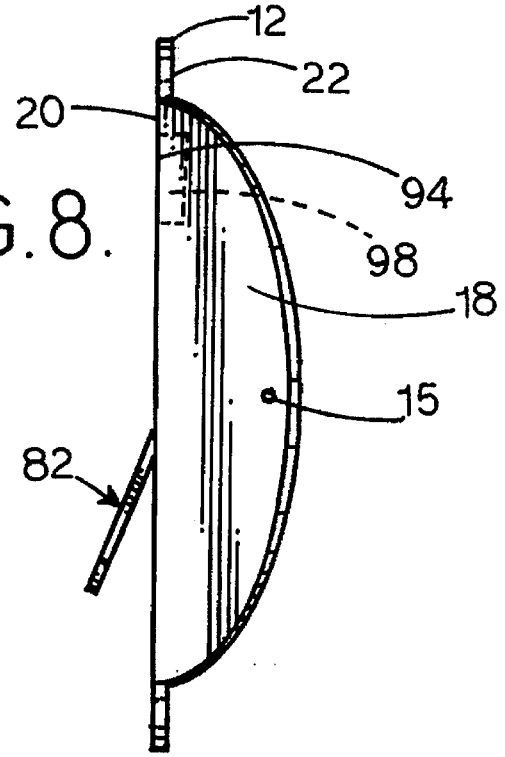
FIG. 8 is a side elevational view thereof with the nose cover in an open configuration, the side opposite being identical to the side shown in FIG. 8.

The second form of the face shield is shown in FIGS. 6–9 as shield 10'. Face shield 10' is circular in peripheral shape and includes two intersecting arcuate cutout sections 60 and 62, and a translucent covering 64 mounted on rear surface 22 of body 12 to cover both of the arcuate cutout sections. The covering is preferably plastic and is formed of a dark material to filter the sun's rays. Material 64 can also be polarized material if desired. Shield 10' further includes two diverging cutlines 66 and 68 each of which has one end 70 and 72 respectively adjacent to one of said arcuate cutout sections. Two intersecting cutout lines 74 and 76 are also defined in the body and each of the lines 74 and 76 intersects one of said diverging cutout lines 66 and 68 respectively at a location spaced from the end 70 and 72 respectively of the diverging cutout lines 66 and 68 and which intersect each other at a location 80 spaced from diverging cutout lines 66 and 68. The cutout lines define a nose-covering section 82 which has a foldline 84 at the proximal end thereof. Foldline 84 defines a living hinge about which nose section 82 pivots from a closed configuration co-planar with body 12 to a use configuration such as shown in FIGS. 8 and 9. The living hinge permits the nose section to be deployed as far as the user desires whereby users having different size noses can be easily accommodated.

The face shield 10' includes means 90 for spacing body 12 from a wearer's face. Means 90 includes a base 92 fixed to rear surface 22 of body 12 as by adhesive, staples 91 or the like, and has foldlines 94 which form living hinges about which face-engaging portion 98 of the means pivots from a storage condition adjacent to the rear surface 22 to a use condition as shown in FIGS. 8 and 9. This feature permits the face engaging element to be adjusted for storage, or for the most comfortable position of the shield with respect to a wearer's face by pivoting the portion 98 around the living hinge formed by the foldlines 94.

As before, printed material can be placed on the front surface 20 of body 12 if desired. Body 12 can also be formed of cardboard or like flexible material so it can be sized and shaped for each wearer or can even be folded for storage. As shown in FIG. 8, a wing can be pivoted about the living hinge associated therewith to protect the side of a wearer's face, and one wing can be left unfolded if the wearer so desires.

It is understood that while certain forms of the present invention have been illustrated and described herein, it is not to be limited to the specific forms or arrangements of parts described and shown.

We claim:

1. A face cover for protecting a wearer from sun comprising:

A) a body which is opaque to the sun's rays, said body having (1) two spaced apart foldlines, (2) two intersecting arcuate cutout sections, (3) a translucent covering mounted on the body to cover both of said arcuate cutout sections, (4) two diverging cutlines each of which has one end adjacent to one of said arcuate cutout sections, and (5) two intersecting cutout lines each of which intersects one of said diverging cutout lines at a location spaced from the one end of said diverging cutout lines and which intersect each other at a location spaced from said diverging cutout lines;

B) a means for spacing said body away from a wearer's face; and

C) a flexible band connected at each end thereof to said body.

2. The face cover defined in claim 1 wherein said body is cardboard.

3. The face cover defined in claim 2 wherein said translucent covering is plastic.

4. The face cover defined in claim 3 wherein said body includes a front surface and a rear surface and said translucent covering is mounted on said rear surface.

5. The face cover defined in claim 4 wherein said means for spacing said body away from the wearer's face is mounted on said rear surface and overlaps said translucent covering.

6. The face cover defined in claim 4 wherein said body is circular in peripheral outline.

7. The face cover defined in claim 6 wherein said foldlines are parallel to each other.

8. The face cover defined in claim 1 wherein said foldlines form living hinges for said body.

9. The face cover defined in claim 7 wherein said means for spacing said body away from the wearer's face includes a foldline which forms a living hinge and which is located closely adjacent to said rear surface whereby said means can be folded to lie against said body.

10. The face shield defined in claim 1 further including a living hinge located adjacent to the one ends of said two diverging cut lines.

11. A face cover for protecting a wearer from sun comprising:

A) a flexible body;

B) two space-apart foldlines defined in said body, said foldlines forming living hinges whereby said body can be folded upon itself;

C) means for spacing said body away from a wearer's face and including foldlines forming living hinges whereby said means can be folded to lie adjacent to said body, said foldlines being located adjacent to said body; and D) a flexible band connected at each end thereof to said body for holding said body on a wearer.

12. The face cover defined in claim 11 wherein side wings are defined between a peripheral edge of said body and each foldline in said body.

13. The face cover defined in claim 12 wherein said body is planar.

14. The face cover defined in claim 13 wherein said body is cardboard.

15. The face cover defined in claim 14 wherein the foldlines in said body are parallel with each other.

* * * * *